US006165038A

United States Patent [19]

Muller

[11] Patent Number: 6,165,038

[45] Date of Patent: Dec. 26, 2000

[54] DOLL

[76] Inventor: Luisa B. Muller, 350 8th Ave., North #8, Tierra Verde, Fla. 33715

[21] Appl. No.: 09/301,446

[22] Filed: Apr. 29, 1999

[51] Int. Cl.[7] ..... A63H 33/22

[52] U.S. Cl. ..... 446/219; 446/485; 446/72; 446/73; 446/74

[58] Field of Search ..... 446/219, 485, 446/73, 72, 268, 74, 76, 369, 71

[56] References Cited

U.S. PATENT DOCUMENTS 3,791,068 2/1974 Pietrowiak ..... 446/485
4,878,674 11/1989 Newcomb et al. ..... 273/213
4,883,442 11/1989 Kaplan ..... 446/369
5,324,201 6/1994 Friedel ..... 446/485
5,672,090 9/1997 Liu ..... 446/485

*Primary Examiner*—Kien T. Nguyen
*Assistant Examiner*—Urszula M. Cegielnik
*Attorney, Agent, or Firm*—Patent & Trademark Services; Joseph H. McGlynn

[57] ABSTRACT

A doll which has a compartment which stores a smaller doll therein. The smaller doll has a body covered with a hexagonal crystalline pattern and an inner light source which shows through the smaller doll body.

8 Claims, 2 Drawing Sheets

FIG. 1
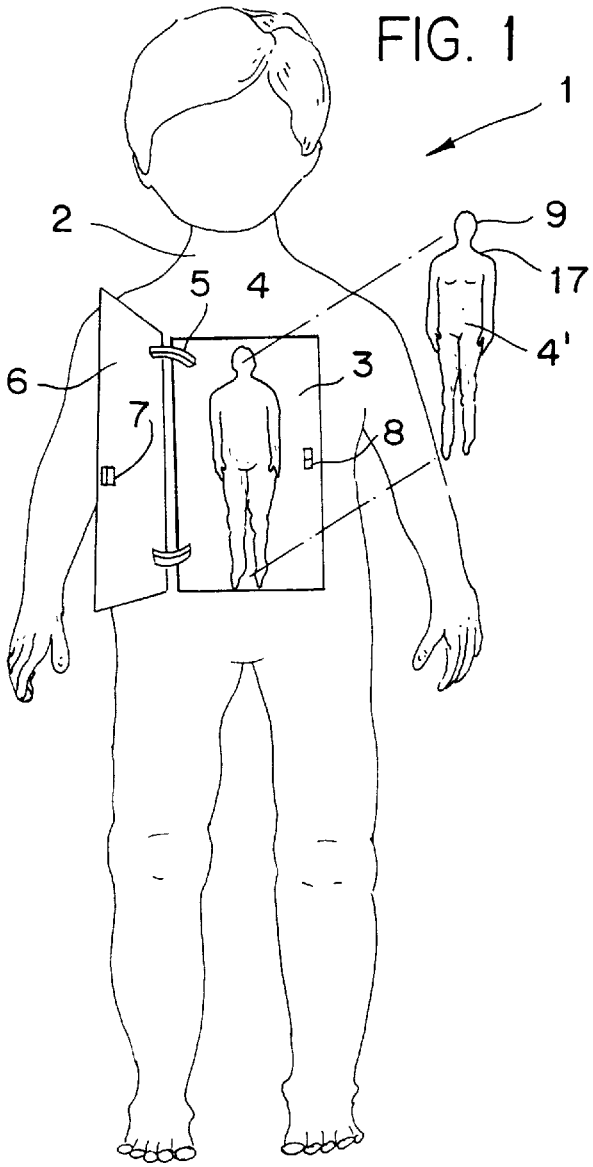
FIG. 2
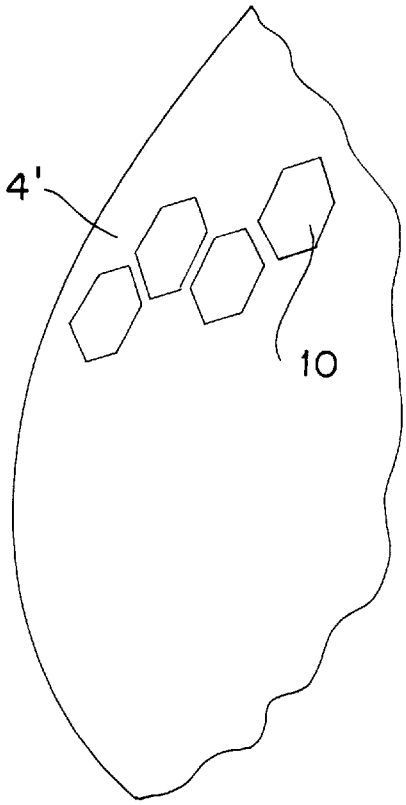
FIG. 3
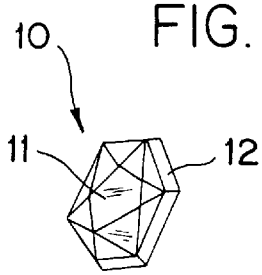
FIG. 4
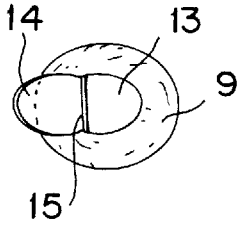
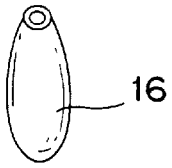
FIG. 5

DOLL

BACKGROUND OF THE INVENTION

This invention relates, in general, to dolls, and, in particular, to a pair of dolls one of which is carried inside the other.

DESCRIPTION OF THE PRIOR ART

In the prior art various types of dolls have been proposed. For example, U.S. Pat. No. 4,336,665 to Moreau discloses a convertible stuffed toy with a pair of head members joined with their neck members connected together.

U.S. Pat. No. 4,614,505 to Schneider et al discloses a toy figure which is transformable into different configurations.

U.S. Pat. No. 4,695,264 to McLeod, Jr. discloses a toy which includes two interconnected figures, each having separate internal cavities each having the capacity to hold the other figure.

U.S. Pat. No. 5,149,289 to Edwards et al discloses a doll having interconnected upper body portions one of which is covered by a skirt that can be moved to cover one of the upper body portions.

SUMMARY OF THE INVENTION

The present invention is directed to a doll which has a compartment which stores a smaller doll therein. The smaller doll has a body covered with a hexagonal crystalline pattern and an inner light source which shows through the smaller doll body.

It is an object of the present invention to provide a new and improved doll.

It is an object of the present invention to provide a new and improved doll which comprises two dolls one of which is stored within the other.

It is an object of the present invention to provide a new and improved doll in which one of the dolls is translucent and has an inner source of light.

These and other objects and advantages of the present invention will be fully apparent from the following description, when taken in connection with the annexed drawings.

BRIEF DESCRIPTION OF THE DRAWINGS

FIG. 1 is a front view of the present invention.

FIG. 2 is a partial view of the present invention showing the formation of the outer skin of the inner doll.

FIG. 3 is a view of one of the hexagonal crystalline structures that make up the outer skin of the inner doll of the present invention.

FIG. 4 is a partial view of the present invention showing the top of the head of the inner doll.

FIG. 5 is a view of one type of light source used with the present invention.

DESCRIPTION OF THE PREFERRED EMBODIMENT

Figure 6:
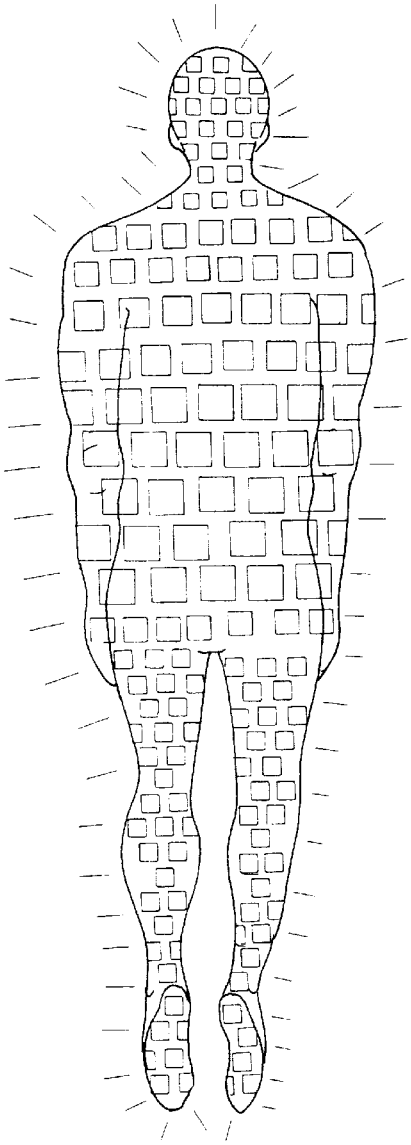
FIG. 6 is a full front view of the inner doll with a light stick inside and glowing through the body.
Figure 7:
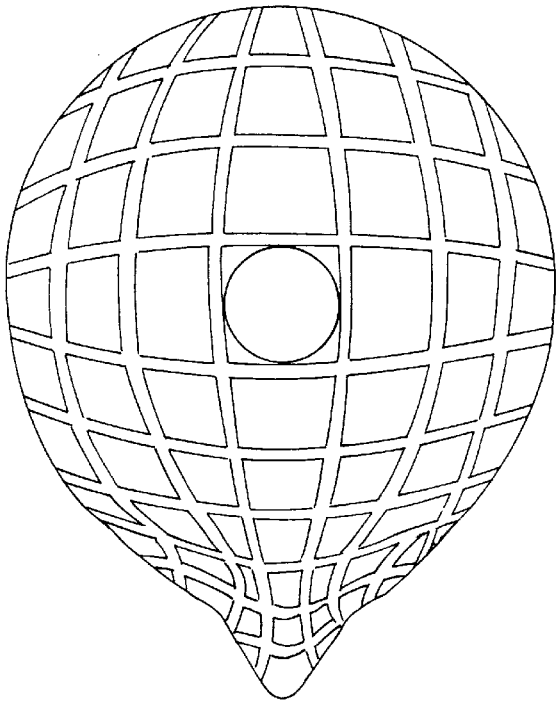
FIG. 7 is a top view of the inner doll's head with the lid removed and with a light stick inside and glowing through the body.

Referring now to the drawings in greater detail, FIG. 1 shows the doll 1 of the present invention.. The doll shown in FIG. 1 is merely an illustration of a type of doll that can be used with the present invention, however, it is not necessarily the only shape that can be used. For example, instead of the male FIG. 2 depicted in FIG. 1, a female figure or an animal figure could be used.

The body of the doll has a cavity 3 disposed in a portion of the body. The cavity 3 has a second cavity 4 which will have the shape of a second doll 4' that will fit into the cavity 4. Also, it should be noted that the cavity 3 is shown as being placed in the front chest area of the doll 2, however, this location is not critical and the cavity 3 could be placed in other areas such as, but not limited to, the back of the doll 2.

The cavity 3 will be covered by a door 6 which is hinged to the body of the doll 2 by any type of conventional hinges 5. The door will have a catch 7 which will cooperate with a complimentary catch holder 8 that will hold the door closed but will allow the door to be opened when desired. The catch 7 and the catch holder 8 are any conventional devices which will accomplish the intended function, and therefore, no further description is necessary.

The second doll 4', as shown in FIG. 2 will have a transparent skin that will allow light to shine through. The skin will be made from, or be covered with a crystalline netting which is comprised of a plurality of hexagonal elements 10. The hexagonal elements 10 will cover the entire area of the body of the doll 4', although only some of the hexagonal elements 10 are shown in FIG. 2 for clarity.

FIG. 3 shows one of the hexagonal elements 10, and as shown, the element 10 has a plurality of facets 11 formed in the top portion, and a plurality of sides 12 which will make the hexagonal elements 10 stand out, away from the surface of the body of the doll 4'. As will be explained below, the facets 11 and the sides 12 will allow light to shine through the body of the doll 4' and will reflect the light in several directions with a diamond-like sparkling effect.

One possible light source is shown in FIG. 5. Element 16 is a CYALUME light stick which can be bent or snapped and then shaken before it is placed into the doll 4'. The light stick will provide a source of light that can be any color such as green, yellow, red or blue, and will shine through the transparent body of the doll 4', and be reflected by the facets and the sides of the crystals 10.

It should be noted that the light stick 16 is only one source of light that can be used with the doll 4'. For example, a conventional light bulb powered by a battery (not shown) could also be used.

In order to introduce the light stick 16 to the inside of the doll 4', an opening 13 could be made in the doll's head 9 which will communicate with a passageway 17 (see FIGS. 1 and 4) and allow a light stick to be inserted into the doll 4'. The opening 13 could be closed with a door 14 that is hinged at 15 to the doll, similar to the door 6.

Although the Doll and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A toy comprising:

a first doll having a cavity therein, means for closing said cavity, a second doll adapted to fit within said cavity, said second doll having a transparent surface, a light source within said second doll.

2. The toy as claimed in claim 1, wherein said light source is a light stick.

3. The toy as claimed in claim 1, wherein said second doll has a cavity therein and said light source is located in said cavity within said second doll.

4. The toy as claimed in claim 1, wherein said cavity within said second doll has means for closing said cavity.

5. The toy as claimed in claim 1, wherein said second doll has a plurality of hexagons covering said second doll.

6. The toy as claimed in claim 5, wherein said hexagons have a plurality of sides which extend away from said second doll, and said sides are transparent.

7. The toy as claimed in claim 5, wherein each said hexagon has a plurality of facets on a surface of each said hexagon.

8. The toy as claimed in claim 5, wherein said facets are transparent.

* * * * *